US008770399B2

(12) United States Patent
Hjalmarsson

(10) Patent No.: US 8,770,399 B2
(45) Date of Patent: Jul. 8, 2014

(54) TWO-COMPARTMENT CONTAINER

(76) Inventor: Per Hjalmarsson, Malmö (SE)

( * ) Notice: Subject to any disclaimer, the term of this patent is extended or adjusted under 35 U.S.C. 154(b) by 503 days.

(21) Appl. No.: 13/136,810

(22) Filed: Aug. 11, 2011

(65) Prior Publication Data

US 2012/0067901 A1 Mar. 22, 2012

Related U.S. Application Data

(63) Continuation-in-part of application No. 11/257,516, filed on Oct. 25, 2005, now Pat. No. 8,016,104.

(51) Int. Cl.
*B65D 25/08* (2006.01)

(52) U.S. Cl.
USPC ..... 206/219

(58) Field of Classification Search
USPC ..... 206/219; 220/521, 703; 215/6, 247, 215/249, DIG. 8
See application file for complete search history.

(56) References Cited

U.S. PATENT DOCUMENTS

| | | | | |
|---|---|---|---|---|
| 2,631,521 | A | 3/1953 | Atkins, Jr. | |
| 3,326,363 | A | 6/1967 | Bennett et al. | |
| 3,349,965 | A | 10/1967 | Krugger | |
| 3,406,872 | A | 10/1968 | Fiquet et al. | |
| 3,415,360 | A | 12/1968 | Baumann et al. | |
| 3,779,372 | A | 12/1973 | de Lloret | |
| 3,968,820 | A | 7/1976 | Kolb et al. | |
| 4,067,440 | A * | 1/1978 | Lataix | 206/222 |
| 4,074,827 | A | 2/1978 | Labe, III | |
| 4,103,772 | A | 8/1978 | Wiegner | |
| 4,609,369 | A | 9/1986 | Ball | |
| 4,637,934 | A | 1/1987 | White | |
| 4,638,927 | A * | 1/1987 | Morane | 222/83 |
| 4,757,916 | A | 7/1988 | Goncalves | |
| 4,785,931 | A | 11/1988 | Weir et al. | |
| 4,786,279 | A | 11/1988 | Wilkinson et al. | |
| 4,874,618 | A | 10/1989 | Seaborne et al. | |
| 5,035,320 | A | 7/1991 | Plone | |
| 5,071,034 | A * | 12/1991 | Corbiere | 222/80 |
| 5,170,888 | A | 12/1992 | Goncalves | |
| 5,255,812 | A | 10/1993 | Hsu | |
| 5,290,574 | A | 3/1994 | Jamieson et al. | |
| 5,370,222 | A | 12/1994 | Steigerwald et al. | |
| 5,417,321 | A | 5/1995 | Halm | |
| 5,419,429 | A | 5/1995 | Zimmerman et al. | |
| 5,514,394 | A | 5/1996 | Lenahan | |
| 5,564,600 | A | 10/1996 | Renault | |
| 5,884,759 | A | 3/1999 | Gueret | |
| 6,003,728 | A | 12/1999 | Elliott | |

(Continued)

FOREIGN PATENT DOCUMENTS

| | | |
|---|---|---|
| FR | 2290366 | 4/1976 |

*Primary Examiner* — Jacob K Ackun
*Assistant Examiner* — Jenine Pagan
(74) *Attorney, Agent, or Firm* — Lynn E. Barber

(57) ABSTRACT

A two-compartment container in which the first compartment has an upper layer and a lower layer and contains a first component that is to be added to the second compartment. There are at least two lacquer layers on the lower layer of the first compartment outside of the first compartment, between the second component and the first compartment. Above the first compartment is a dome that is bowed upward and is flexible. Depressing the dome by pushing downward on it causes the lower layer of the first compartment to be ruptured without cutting or rupturing the upper layer, releasing the first component into the second compartment.

3 Claims, 1 Drawing Sheet

(56) References Cited

U.S. PATENT DOCUMENTS

| | | | | |
|---|---|---|---|---|
| 6,098,795 | A | 8/2000 | Mollstam et al. | |
| 6,105,760 | A | 8/2000 | Mollstam et al. | |
| 6,186,998 | B1 * | 2/2001 | Inuzuka et al. | 604/410 |
| 6,209,718 | B1 | 4/2001 | Mollstam et al. | |
| 6,305,576 | B1 * | 10/2001 | Leoncavallo | 222/83.5 |
| 6,435,341 | B1 | 8/2002 | Nobbio | |
| 6,454,088 | B2 | 9/2002 | Mollstam et al. | |
| 6,513,650 | B2 | 2/2003 | Mollstam et al. | |
| 6,769,539 | B2 | 8/2004 | Stern et al. | |
| 6,786,330 | B2 | 9/2004 | Mollstam et al. | |
| 6,938,757 | B2 * | 9/2005 | Eastman et al. | 206/219 |
| 7,055,683 | B2 | 6/2006 | Bourque et al. | |
| 7,090,880 | B1 | 8/2006 | Droste et al. | |
| 2002/0066680 | A1 * | 6/2002 | Stern et al. | 206/222 |
| 2003/0223219 | A1 | 12/2003 | Ladyjensky | |
| 2004/0011679 | A1 * | 1/2004 | Vlodek | 206/219 |
| 2004/0026270 | A1 | 2/2004 | Liang | |
| 2006/0254935 | A1 * | 11/2006 | Pearce et al. | 206/219 |

* cited by examiner

TWO-COMPARTMENT CONTAINER

CROSS-REFERENCE TO RELATED APPLICATIONS

This application is a continuation-in-part of U.S. patent application Ser. No. 11/257,516 filed Oct. 25, 2005 now U.S. Pat. No. 8,016,104.

BACKGROUND OF THE INVENTION

1. Field of the Invention

This invention relates to packages and containers, and in particular, pertains to containers having two compartments and that may be used to keep two components separate until use.

2. Description of the Related Art

Many different types of packages have been designed to enable product components to be kept separate until use and, in some cases, to allow one component to remain sterile until use of the product. In one type of two-compartment package, a stopper or other means is placed in the hole between the two compartments. For example, the two-compartment container of Halm (U.S. Pat. No. 5,417,321) comprises a one-piece container having two compartments assembled one upon another interlinked by a stoppered opening. The disclosure of all patents referred to herein is incorporated herein by reference.

Other two-compartment packages utilize a perforating unit to allow the two previously separated components to mix. See, for example, the patents of Goncalves (U.S. Pat. No. 5,170,888 which has a glass defining a first compartment, which is provided with a neck upon which is mounted a bottle defining a second compartment, with a membrane between the two compartments that is perforated when a perforating unit is displaced relative to the glass, and U.S. Pat. No. 4,757,916 which has two units separated by a cover perforatable as a result of the manipulation of a mixing perforator). The two-part container of Wiegner (U.S. Pat. No. 4,103,772) has a frangible partition of coated aluminum foil dividing the compartments and a piercing member mounted on a resilient portion transversely directed toward the partition. In the patent of White (U.S. Pat. No. 4,637,934) rigid penetrating means are used to penetrate a compartment closing diaphragm to allow nursing liquid to flow from the compartment to a communicating, attached nipple.

Two compartment packages have also been previously developed which have an opening container attached to the top of the package and are provided with a screw cap and a cylinder jacket shaped supporting ring. The cylinder jacket shaped supporting ring is attached to the top of the package by means of a fixing flange externally surrounding the opening disc and is provided on its inner surface with a raised thread. The ring surrounds the external thread of the plastic screw cap. A cutter is integrally molded onto the free edge of the screw cap, and is provided with a front cutting edge which passes at an angle through the free edge.

For such products as two-part epoxy glues, two compartments are also needed to keep the products from reacting, as in the patent of Wilkinson et al. (U.S. Pat. No. 4,786,279).

The dispenser of Renault (U.S. Pat. No. 5,564,600) has two compartments separated by a sealing member sealed against a seat, so that movement of one of the containers relative to the other causes the sealing member to move away from the seat and form an annular passage between the sealing member and the seat.

U.S. Pat. Nos. 6,209,718, 6,105,760, 6,513,650 and 6,786,330 disclose a two-compartment package, which keeps a first component separate from a liquid component until use, so that the first component does not become wetted until just before use. The two-compartment package keeps at least one of the components sterile until just before use, at or before which time, the two components may be easily mixed. The prior invention can thus be used for containers for the separate packaging of dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption.

U.S. Pat. No. 6,098,795 discloses a container and means for adding a selected component to a main package, thus forming a two-compartment container that keeps a first component, which may, for example, be moisture sensitive, from a second component, preferably a liquid, until a selected time before use. The delivery package, preferably containing a second component in a compartment inside a cavity in the delivery package, may be mountable on the outside surface of a main package. A puncture means is provided for cutting through the compartment and the main package to gain access to the main package, for example, to release the first component from the compartment into the main package. Alternatively, the main package may be a bag, such as an enteral bag in the preferred use of the first embodiment. In the second embodiment of the invention, the main package preferably is for holding a liquid beverage, and the delivery package is attached to the main package during the manufacturing process.

In some cases, such as with aseptically-filled bottles or cartons, there is a need to provide a means for adding a selected separate first component to a package after manufacture of the package and/or at a location on the package, which component may vary in concentration and/or composition, depending, for example, on the patient's history and diagnosis. Providing a means of attaching a first compartment to a package after both the first compartment and package have been manufactured allows a user to select both a particular first component to add to a package and the time and place of addition of the first component to the package. There is also need to have the capability to add beverage additives, particularly degradable or moisture-sensitive or oxygen-sensitive components (for example, vitamins) to liquid beverage bottles at or just before the time the beverage is consumed.

The types of structures used for many prior two-compartment containers are complicated and often subject to leakage. Thus, there remains a need to have two-compartment packages which keep a first component separate from a liquid component until use, so that the first component does not become wetted until just before use, that keep at least one of the components sterile until just before use, and in which the two components may be easily mixed just before use, and which has minimal or no leakage prior to mixing of the components and once the components have been mixed. For example, there is a need for such containers for the separate packaging of dried microbial cultures which are to be added to a food, liquid nutrition, medicine, or beverage product just before consumption, for the separate packaging of carbonation tablets from a liquid until just before consumption, and for separate packaging of for example vitamins, flavoring or coloring agents or other unstable components before addition to a beverage, liquid nutrition, medicine or beverage before consumption.

It is therefore an object of the invention to provide a two-compartment container that keeps a first component, which may be moisture sensitive, from a second component, preferably a liquid, until a selected time before use, and that then the separation between the components may be removed without utilizing a puncturing structure.

It is a further object of the invention to provide a two-compartment container that has improved manufacturability and decreased leakage.

Other objects and advantages will be more fully apparent from the following disclosure and appended claims.

SUMMARY OF THE INVENTION

The invention herein is a two-compartment container. The first compartment has an upper layer and a lower layer and contains a first component that is to be added to the second compartment. There are at least two lacquer layers on the lower layer of the first compartment outside of the first compartment, between the second component and the first compartment. Above the first compartment is a dome that is bowed upward and is flexible. Depressing the dome by pushing downward on it causes the dome to rupture the lower layer of the first compartment, without rupturing the upper layer, releasing the first component into the second compartment.

Other objects and features of the inventions will be more fully apparent from the following disclosure and appended claims.

DETAILED DESCRIPTION OF THE INVENTION AND PREFERRED EMBODIMENTS THEREOF

The present invention provides an improved two-compartment container having a depressible dome to release a sensitive component from a first compartment into a second compartment by rupturing a lower layer between the compartments, with minimal or no possibility of leakage.

As used herein, the relative directional terms "above", "below" and the like are used to specify the relative orientations of the parts of the invention when the container is a bottle, carton or the like oriented having the opening of the second compartment facing upward. In particular structures or usages of the container of the invention, the container may be oriented in other manners without departing from the invention herein, and it is understood that in such instances, the actual orientation of the parts of the invention are correspondingly changed.

Figure 1:
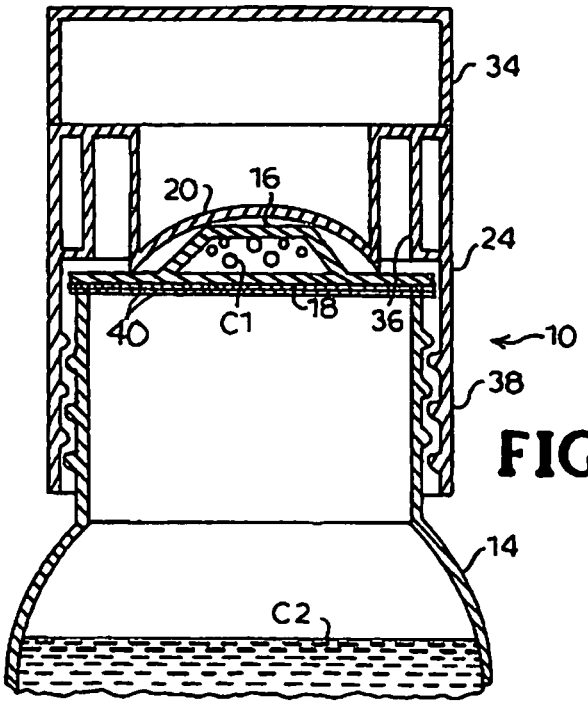
FIG. 1 is a cross-sectional view of the invention showing the dome when not depressed, showing two lacquer layers according to the invention herein.
Figure 2:
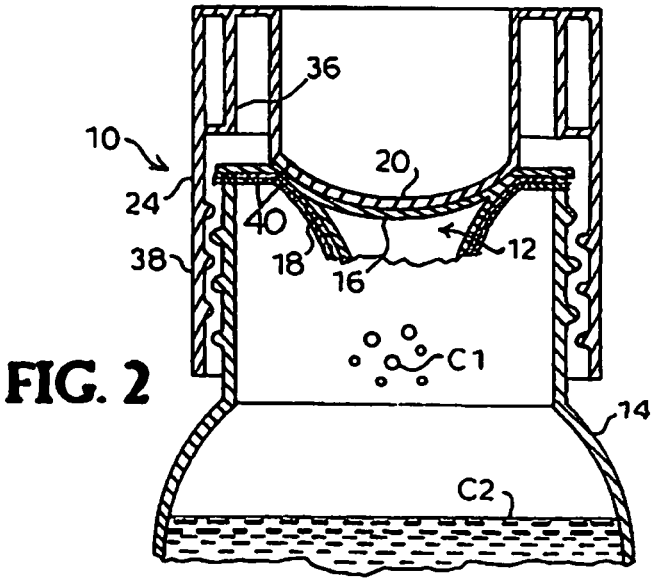
FIG. 2 is a cross-sectional view of the invention of FIG. 1 showing the dome when depressed.

In particular, the invention herein is container 10 comprising a first compartment 12 and a second compartment 14 (FIGS. 1-2). Although generally the second compartment 14 serves as the main compartment containing second component C2 that is normally a liquid, and the first compartment 12 serves as a delivery package for a first component C1 to be added to the second compartment 14, it is understood that by use of the terms "main" package and "delivery" package as used herein, no limitation is placed on the absolute or relative sizes of the packages. The terms are used merely to distinguish the two packages by difference in function and structural characteristics, with the main package including packages known in the prior art for holding substances and the delivery package preferably designed for holding a first component to be added to the main package. In the preferred embodiments herein, the second compartment 14 is a screw-capped bottle or a carton, such as a juice carton as is known in the art.

The first compartment 12 has an upper layer 16 and a lower layer 18 and contains a first component C1 that is to be added to the second compartment 14. The structure of the first compartment 12 is preferably similar to those disclosed in prior patents of the referred to above (see, for example, U.S. Pat. Nos. 6,098,795; 6,105,760; 6,209,718; and 6,786,330), the disclosure of which is incorporated herein by reference. Thus, a preferred first compartment 12 is preferably made of foil, and most preferably of foil having a plastic layer on one surface on the outside of the compartment, such as a polyvinyl laminated aluminum foil and with a lacquered surface on the inside such as OPA lacquer, for example, material nr 3131781 of ALCAN PACKAGING AG, (Kreuzlingen Switzerland). Above the first compartment 12 is a dome 20 that is part of the cap 24 covering the second compartment 14 and that is bowed upward and is flexible. Preferably, the dome 20 is formed of a thin flexible plastic material, as is known in the art.

In the invention herein, collar 36 extending above a threaded area 38 of the cap 24 holds the dome 20 suspended over the second compartment 14. Thus, in use of the invention, depressing the dome 20 by pushing downward on it lowers the dome 20 so that the lower layer 18 of the first compartment 12, but not upper layer 16, is ruptured by pressure of dome 20, releasing the first component C1 into the second compartment 14. Because upper layer 16 is not cut or ruptured, there is not leakage from the outer part due to the movement.

In the invention, the first compartment 12 is bowed upward, with the upper layer 16 preferably being quite thick, such as being made of a thick plastic and/or foil material. The flat lower layer 18 is a thin, easily rupturable foil. Thus, when dome 20 is depressed in this embodiment, it pushes upper layer 16 downward as shown in FIG. 2, so the intact but pushed downward upper layer 16 is pushed against and ultimately ruptures lower layer 18 as shown, without puncturing or rupturing upper layer 16.

The second compartment is intended to incorporate liquid for drinking, e.g. various beverages and drinks, for example fruit juice or other juices, milk, water, soft drink, sports or energy drink, alcoholic beverages, liquid enteral nutrition or medicine. Liquids incorporated in the second compartment may have a low pH or other characteristics that might have a negative impact on the lower layer of the first compartment, e.g. having corrosive properties negatively affecting the barrier function of the aluminum foil. In order to avoid corrosion, the outside of the lower layer of the first compartment, i.e. the lower layer surface facing the content of the second compartment 14, may be coated with lacquer layers 40 creating an effective protective barrier between the liquid of the second compartment and the aluminum foil of the lower layer of the first compartment (FIGS. 1-2). While two lacquer layers 40 are shown in the figures, this layer 40 could comprise additional lacquer layers. A single lacquer layer is found sometimes not to be enough protective as pores or cavities may be present in the lacquer layer, and these pores or cavities may bring the underlying aluminum foil in contact with the liquid of the second compartment leading to corrosion of the aluminum foil. A solution to this problem is to add at least one additional lacquer layer on the outer surface of the first compartment providing a barrier composed of two or several lacquer layers between the liquid and the aluminum foil.

Preferable two lacquer layers 40 as shown are applied as a barrier to protect the aluminum foil from the liquid, providing a double lacquer layer. Preferably these lacquer layers continue over the threaded edge of the bottle opening as shown. However, three, four or five layers of lacquer are also contemplated. The lower layer of the first compartment including this lacquer barrier composed of at least two lacquer layers is easily rupturable in order rupture upon depressing of the dome without rupturing the upper layer.

In the invention, there is preferably an outer cap 34 over the cap 24, as shown in FIG. 1, which prevents accidental depression of the dome 20 prior to use, such as during shipping and storage. The form of this cap 34 may be any known in the art or as may be useful, and is not a specific part of the invention herein.

The invention is primarily designed for addition of a selected, sensitive first component C1, preferably located in first compartment 12, to a liquid located in the main package (second compartment 14). The term "selected" first component C1 as used herein includes first component(s) chosen for a particular use, e.g., addition to a bottle or carton to be used by a person requiring additional vitamins or antibiotics, or having a particular volume or concentration, and the like. The first component may be a single compound, mixture, solution, capsule, tablet, powder, or any other containable component (s) to be added to a main package that preferably contains a second component (which may in turn be any containable compound(s) to which the first component may be added to result in a useful product. The ability to select from an assortment of pre-packaged first components in the first embodiment herein allows the purchaser to purchase and store first and second components separately, for example, to keep non-perishable second components at room-temperature, and to keep first compartments, each of which has one of any number of assorted first components under appropriate, possibly separate, storage, for later addition to the second component. When the first component C1 comprises microorganism cells, the first component is preferably in a powdered formulation as described in the parent applications hereto.

The term "sensitive" includes first components which are moisture-sensitive, or which interact with the second component, for example, by forming by-products that change the usefulness of the combined components, for example, from initially useful to too weak, due, for example, to loss or change of strength or value with time after the combination of components. "Sensitive" first components also include those components that may require special storage and/or handling until just before addition to a second component, for example, refrigeration, desiccation, or heating; as well as first components that for any other reason(s) are desired to be kept separate from a second component between the time of manufacture and until a later time, such as the time of addition to a second component.

It is preferred that the first component be in the form of a powder that is stable when dry and that is easily dissolved or suspended in the liquid in the main package as disclosed in the parent applications hereto. The invention is particularly useful for adding unstable and/or sterile components to a beverage, liquid enteral nutrition or medicine, for example, adding vitamins or beneficial gastrointestinal microorganisms, such as *Lactobacillus reuteri,* to fruit juice, milk, water, and medicine.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A two-compartment container, for addition of a first component to a second component, comprising:

(a) a first compartment containing a first component, said first compartment having an upper layer and a lower layer, said lower layer of the first compartment being made of a rupturable material;

(b) a second compartment containing the second component, said second compartment having a cap containing a flexible dome; and (c) at least two lacquer layers coating the lower layer between the second component in the second compartment and the lower layer;

wherein depression of said flexible dome causes the lower layer and the at least two lacquer layers to be ruptured but not the upper layer, releasing the first component into the second compartment without opening either compartment outside the container.

2. The container according to claim 1, wherein the upper layer is thicker than the lower layer.

3. The container according to claim 1, wherein there are 2-5 lacquer layers.

* * * * *